US011085223B2

(12) United States Patent
Oestermann et al.

(10) Patent No.: US 11,085,223 B2
(45) Date of Patent: Aug. 10, 2021

(54) OPENING AND CLOSING SYSTEM HAVING AN EJECTION APPARATUS FOR AN ITEM OF FURNITURE, AND OPERATING METHOD FOR AN OPENING AND CLOSING SYSTEM

(71) Applicant: HETTICH-ONI GMBH & CO. KG, Vlotho (DE)

(72) Inventors: Markus Oestermann, Sendenhorst (DE); Ulrich Ermler, Bad Oeynhausen (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 242 days.

(21) Appl. No.: 16/344,438

(22) PCT Filed: Oct. 26, 2017

(86) PCT No.: PCT/EP2017/077520
§ 371 (c)(1),
(2) Date: Apr. 24, 2019

(87) PCT Pub. No.: WO2018/078055
PCT Pub. Date: May 3, 2018

(65) Prior Publication Data

US 2020/0056414 A1 Feb. 20, 2020

(30) Foreign Application Priority Data

Oct. 27, 2016 (DE) ..... 10 2016 120 593.1

(51) Int. Cl.
*E05F 15/622* (2015.01)
*E05F 15/79* (2015.01)
*E05F 1/10* (2006.01)

(52) U.S. Cl.
CPC ..... *E05F 15/622* (2015.01); *E05F 1/105* (2013.01); *E05F 15/79* (2015.01);
(Continued)

(58) Field of Classification Search
CPC ..... E05Y 2900/20; E05Y 2400/612; E05Y 2201/426; E05F 15/622; E05F 15/79; E05F 1/105
See application file for complete search history.

(56) References Cited

U.S. PATENT DOCUMENTS 4,729,490 A * 3/1988 Ziegenbein ..... B65F 1/1638 220/211
6,408,483 B1 * 6/2002 Salice ..... E05F 5/02 16/85
(Continued)

FOREIGN PATENT DOCUMENTS

AT 413933 B 7/2006
AU 2008286296 A9 2/2009
(Continued)

OTHER PUBLICATIONS

Office Action in corresponding/related Chinese Application No. 201780066534.6 dated Aug. 4, 2020.
(Continued)

*Primary Examiner* — Justin B Rephann
(74) *Attorney, Agent, or Firm* — Patent Portfolio Builders PLLC

(57) ABSTRACT

An opening and closing system for an item of furniture, which has at least one movable furniture part and a movement fitting. The opening and closing system has an ejection apparatus having a loadable mechanical force store and a loading device for loading the mechanical force store. The loading device is supplied with energy from an electric energy store. The ejection apparatus is configured to move
(Continued)

Figure 1A:
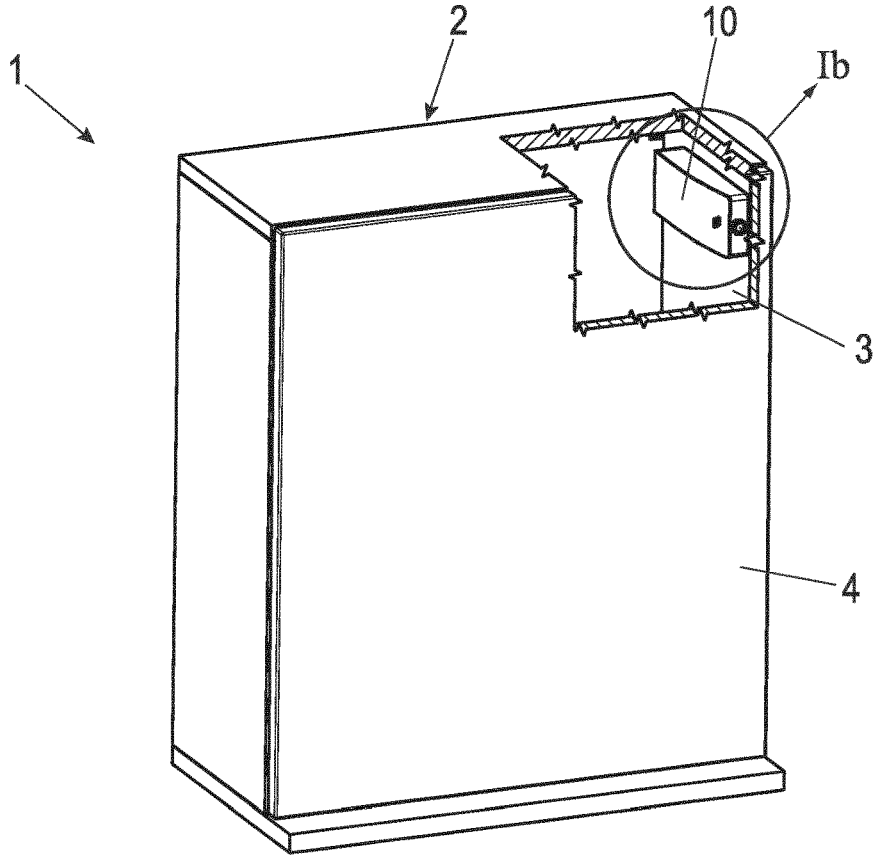

the movable furniture part into a partly opened position when the mechanical force store is unlocked. The movement fitting has a retraction apparatus and a damping apparatus, which move the movable furniture part from a further partly opened position lying within a predefined area of action, in a damped manner into a closed position, and the partly opened position of the movable furniture part achieved by the ejection apparatus lying within the predefined range of action of the retraction apparatus.

22 Claims, 11 Drawing Sheets

(52) U.S. Cl.
CPC ... *E05Y 2201/426* (2013.01); *E05Y 2201/686* (2013.01); *E05Y 2400/612* (2013.01); *E05Y 2900/20* (2013.01)

(56) References Cited

U.S. PATENT DOCUMENTS

| | | | | |
|---|---|---|---|---|
| 8,109,583 | B2 | 2/2012 | Bruestle | |
| 8,720,010 | B2 | 5/2014 | Forster | |
| 9,428,950 | B2 * | 8/2016 | Braungart | E05F 1/105 |
| 9,500,015 | B2 * | 11/2016 | Omann | E05F 1/1058 |
| 9,739,081 | B2 | 8/2017 | Stuke | |
| 9,771,750 | B2 * | 9/2017 | Held | E05F 5/02 |
| 10,172,461 | B2 | 1/2019 | Fischer et al. | |
| 2004/0181903 | A1 * | 9/2004 | Salice | E05F 5/02 16/82 |
| 2006/0220284 | A1 * | 10/2006 | Holzapfel | E05F 5/10 267/124 |
| 2009/0072687 | A1 * | 3/2009 | Fitz | E05F 5/02 312/319.5 |
| 2011/0005032 | A1 * | 1/2011 | Domenig | E05F 5/006 16/54 |
| 2011/0094055 | A1 * | 4/2011 | Domenig | E05F 5/02 16/83 |
| 2013/0091768 | A1 | 4/2013 | Houser et al. | |

FOREIGN PATENT DOCUMENTS

| | | | |
|---|---|---|---|
| CN | 1945178 | A | 4/2007 |
| CN | 101605479 | A | 12/2009 |
| CN | 101861110 | A | 10/2010 |
| CN | 101861441 | A | 10/2010 |
| CN | 204410148 | U | 6/2015 |
| CN | 204418892 | U | 6/2015 |
| DE | 20308223 | U1 | 8/2003 |
| DE | 202004007168 | U1 | 8/2004 |
| DE | 10121977 | B4 | 4/2007 |
| DE | 202008007432 | U1 | 8/2008 |
| DE | 102010031940 | A1 | 3/2011 |
| DE | 202011103288 | U1 | 10/2012 |
| EP | 1716781 | A2 | 11/2006 |
| EP | 2176486 | B1 | 2/2012 |
| ES | 1058289 | U | 12/2004 |
| WO | 2008135315 | A2 | 11/2008 |
| WO | 2010009780 | A1 | 1/2010 |
| WO | 2014118320 | A1 | 8/2014 |
| WO | 2016106434 | A1 | 7/2016 |

OTHER PUBLICATIONS

International Search Report dated Jan. 29, 2018 in related/corresponding International Application No. PCT/EP2017/077520.
Search Report created on Oct. 27, 2017 in related/corresponding DE Application No. 10 2016 120 593.1.
Written Opinion dated Jan. 29, 2018 in related/corresponding International Application No. PCT/EP2017/077520.
Office Action dated Nov. 19, 2020 in related/corresponding RU Application No. 2019114864.

* cited by examiner

OPENING AND CLOSING SYSTEM HAVING AN EJECTION APPARATUS FOR AN ITEM OF FURNITURE, AND OPERATING METHOD FOR AN OPENING AND CLOSING SYSTEM

BACKGROUND AND SUMMARY OF THE INVENTION

Exemplary embodiments of the invention relate to an opening and closing system for an item of furniture comprising at least one movable furniture part and a movement fitting. The opening and closing system comprises an ejection apparatus having a loadable mechanical force store and a tensioning apparatus for loading the mechanical force store, wherein the tensioning apparatus is supplied with energy via an electrical energy storage device. The ejection apparatus is designed to move the movable furniture part to a partially open position when the mechanical force store is unlocked. The invention also relates to an operating method for such an opening and closing system.

For furniture, especially furniture with hinged doors as movable parts, so-called push-to-open devices are known, with which the door can also be operated without a handle mounted on the door or a recessed grip. For opening, the door is pushed from its closed rest position further in the direction of the furniture body, whereupon an ejection element, for example a plunger, extends and presses the door open at least so far that it can be gripped behind for opening. For closing the door, it is closed against the force of the ejection element, which again re-tensions the force store of the ejection apparatus. As a rule, a locking mechanism with a heart cam is provided as the control curve, which holds the ejection element in the tensioned position until the door presses against the furniture body again.

Publication AT 413 933 B discloses an ejection apparatus for furniture, in which a plunger serves as an ejection element with spring force application for ejecting the movable furniture part. In addition, an electric drive unit is provided which, after the movable furniture part has been pushed open, re-tensions the force store of the ejection apparatus again and thus retracts the ejection element. This enables a more convenient closing process for the user of the furniture part, for example of the furniture door, since the effort required to tension the force store of the ejection apparatus is no longer required. In such an arrangement, the ejector can also be combined with a self-retraction apparatus, which makes the closing process of the furniture part even more comfortable and ensures that the closed position is safely assumed.

Publication AT 413 933 B discloses a sensor, which registers a movement of the movable furniture part by the user, to control the drive unit. According to the specification, the force store of the ejection apparatus is locked in the loaded position by the drive unit. After detection of the movement of the furniture part by the user, the drive unit first releases the lock so that the force store relaxes and the furniture part moves and pulls the ejection element back into the retracted position while loading the force store.

The disadvantage of the known system is that a closing process must always be carried out manually. In particular, if the ejection apparatus has been triggered unintentionally by the user, there is a risk that the door will remain in the partially open position until it is closed again by the user. In particular, in the case of a household appliance such as a refrigerator or a freezer, which is regarded as an item of furniture in the context of the application, it would be desirable if, following an unintentional triggering of the ejection mechanism, the door, as a moved furniture part, were to automatically return to the closed position.

Accordingly, exemplary embodiments are directed to an opening and closing system of the type mentioned above and an operating method for such an opening and closing system, in which the movable furniture part is automatically moved back to the closed position after an unintentional triggering of the ejection apparatus.

An opening and closing system according to the invention and of the type mentioned initially involves the movement fitting comprises a retraction apparatus and a damping apparatus, which is provided to move the movable furniture part from a partially open position, which lies within a predetermined effective range, in a damped manner into a closed position. In this case, the partially open position of the movable furniture part achieved by the ejection apparatus lies within the specified effective range of the retraction apparatus.

In this way, when the ejection element of the ejection apparatus is pulled in, the movable furniture part, e.g., a door or a pushing element, is moved back into the closed position by the retraction apparatus. When the ejection element is retracted, automatic closing is thus achieved even after the ejection apparatus has been triggered unintentionally. In this case, the forces exerted on the furniture part by the force store of the ejection apparatus and the retraction apparatus are selected in such a way that the ejection apparatus can open the furniture part against the force of the retraction apparatus and—as long as the ejection element is not retracted by the tensioning apparatus—also keep it open. As mentioned at the beginning, household appliances such as refrigerators or freezers are to be regarded as furniture for which the opening and closing system in accordance with the invention can be used.

In an advantageous embodiment of the opening and closing system, the ejection apparatus has a linearly displaceable plunger as ejection element for the movable furniture part. A spring is preferably provided as a mechanical force store. A heart cam control is also preferably provided in order to lock the plunger in a retracted rest position when the spring is tensioned and to release it beyond the rest position after mechanical impression. In this way, the ejection apparatus is fully mechanically operable. The automatic tensioning of the spring by the tensioning apparatus represents a comfort function but is not a prerequisite for the push-to-open functionality. Thus, the opening and closing system remains usable even in the event of a malfunction of electrical system components or a discharged energy store. Preferably batteries, e.g., disposable batteries or rechargeable batteries, can be used as energy storage device. The energy storage formed by the batteries provides a nominal voltage of 0.8 V (Volt) to 24 V.

In another advantageous embodiment of the opening and closing system, the tensioning apparatus has a sensor that detects a position of the plunger. The sensor can be used to activate the tensioning apparatus. Preferably, a timer is started that initially runs without further actions for an adjustable or fixed time. During this time the user is given the opportunity to grip behind and completely open the movable furniture part pushed by the ejection apparatus. The time can range from a few seconds to a few tens of seconds. After this time has elapsed, the tensioning apparatus is then activated.

Alternatively, the ejection apparatus may have a mechanical slider projecting in a pretensioned manner over a housing of the ejection apparatus and resting in a closed position of the movable furniture part against it, wherein the ejection apparatus has a sensor that detects a position of the slider. The mechanical slide is preferably a sleeve which is arranged concentrically to and around the plunger.

In both cases, the sensor can be a pushbutton whose contacts are open, e.g., when the movable furniture part is in the closed position.

In a further advantageous embodiment of the opening and closing system, the tensioning apparatus of the ejection apparatus has an electric motor, preferably a DC low-voltage motor, having a downstream gear and a spindle, wherein a spindle nut arranged on the spindle engages in a driver of the plunger in order to move it into the rest position. Such a design is compact and, for example, quiet in operation when helical gears are used in the gear unit.

In another advantageous embodiment, the tensioning apparatus only performs the tensioning operation if the voltage of the electrical energy storage device is above a defined undervoltage limit of at least 3 V nominal voltage or a higher value. This ensures that the spindle nut can always be moved to the rest position. The undervoltage limit is checked before each tensioning operation. If the voltage falls below the undervoltage limit, no further tensioning operation is triggered. At this point the battery can be replaced, wherein the ejection apparatus can continue to be operated. Only the tensioning operation must then be carried out manually by a person.

In another advantageous embodiment, the tensioning apparatus only performs the tensioning operation if the voltage of the electrical energy storage device is below a defined overvoltage limit of at most 24 V or a low value. This measure protects the system against overvoltage.

It is advantageous that the undervoltage limit and the overvoltage limit are selected so that a difference between the two limit values is at least 1.8 V.

In a further embodiment, the ejection apparatus comprises a circuit board with a control device comprising a microcontroller and switching elements controlled by it in an H-bridge arrangement for controlling the motor.

Preferably, the switching elements of the H-bridge arrangement are MOSFETs (metal-oxide semiconductor fields effect transistors) or IGBTs (insulated gate bipolar transistors) and the microcontroller is designed in CMOS (complementary metal-oxide semiconductor) technology. In this way, a low quiescent current and high energy efficiency in operation can be achieved, so that a battery service life of up to two years can be achieved using standard commercial batteries and an average actuation frequency of up to 20 ejection cycles per day. The control device has a sleep mode, wherein, in the sleep mode, the maximum quiescent current consumption is less than 200 nA and preferably less than 150 nA.

In another advantageous embodiment of the opening and closing system, the control device has current measuring means for measuring an operating current of the motor. The control device is preferably set up to detect an end position of the spindle nut by exceeding a preset limit value of the measured motor current. In this way, a sensor for detecting the end position of the spindle nut can be dispensed with, which simplifies the mechanical design of the ejection apparatus and reduces manufacturing costs. Further preferably, the limit value is dependent on a measured voltage of the electrical energy storage device, e.g., the batteries. This ensures reliable recognition of the end position of the spindle nut even when the batteries are in a decreasing state of charge.

In another advantageous embodiment of the opening and closing system, the movement fitting is designed as a hinge with a retraction apparatus and an integrated damping apparatus. The hinge can be a single-joint, four-joint or seven-joint hinge with integrated damping. For example, generic hinges are disclosed in DE 20 2011 103 288 U1, DE 101 21 977 B4, EP 2 176 486 B1 or WO2014/118320A1. The damping apparatus in the hinge can have a tension or compression linear damper or a rotation damper. These dampers can be arranged in the hinge pot or in the hinge arm.

Advantageously, the hinge has a hinge pot, which is mounted on the door side, and a hinge arm, which is mounted either directly or by means of a mounting plate on the furniture body side. The hinge has a closing spring and a damping apparatus. The closing spring acts here as a retraction apparatus. The damping apparatus in the hinge can have a tension or compression linear damper or a rotation damper. These dampers can be arranged in the hinge pot or in the hinge arm.

In a further advantageous embodiment of the hinge, the linear damper is pivotably arranged in the hinge arm and coupled via coupling means at least temporarily to at least one articulated arm of the hinge.

In another advantageous embodiment of the hinge, the damping apparatus and the retraction apparatus of the hinge are effective during the closing process between an opening angle of the door of at least 10° and a closed position of the door.

The operating method according to the invention is configured for an opening and closing system for an item of furniture comprising at least one movable furniture part and a hinge with a retraction apparatus and a damping apparatus, wherein the opening and closing system comprises an ejection apparatus with a loadable mechanical force store and a tensioning apparatus for loading the mechanical force store, wherein the tensioning apparatus is supplied with energy by an electrical energy storage device. The operating method consists of the following steps: The ejection apparatus of the opening and closing system moves the movable furniture part after manual pressing of the movable furniture part by means of an ejection element into a partially open position. After a predetermined period of time, the tensioning apparatus loads the mechanical force store and retracts the ejection element, wherein during the retraction of the ejection element the movable furniture part is moved into a closed position by the retraction apparatus of the hinge and against a damping effect of the damping apparatus. The predetermined time period gives the user the opportunity to completely open the furniture part pushed open. If this is not the case, the furniture part is automatically brought back into the closed position by the interplay of tensioning apparatus and retraction apparatus. This results in the advantages described in connection with the opening and closing system.

In the case of advantageous further development of the operating method, the ejection element is a linearly movable plunger and the tensioning apparatus of the ejection apparatus comprises an electric motor, preferably a DC low-voltage motor, having a downstream gear and a spindle, wherein a spindle nut arranged on the spindle can engage in a driver of the plunger. During the tensioning process, the spindle nut is moved in such a way that the plunger is moved into a retracted position. The spindle nut is then moved in the opposite direction to a rest position. In this case, a heart cam control is preferably provided to lock the plunger in the retracted rest position, wherein the rest position of the plunger for locking is reached while the spindle nut moves in the direction of its rest position.

BRIEF DESCRIPTION OF THE DRAWING FIGURES

Figure 1B:
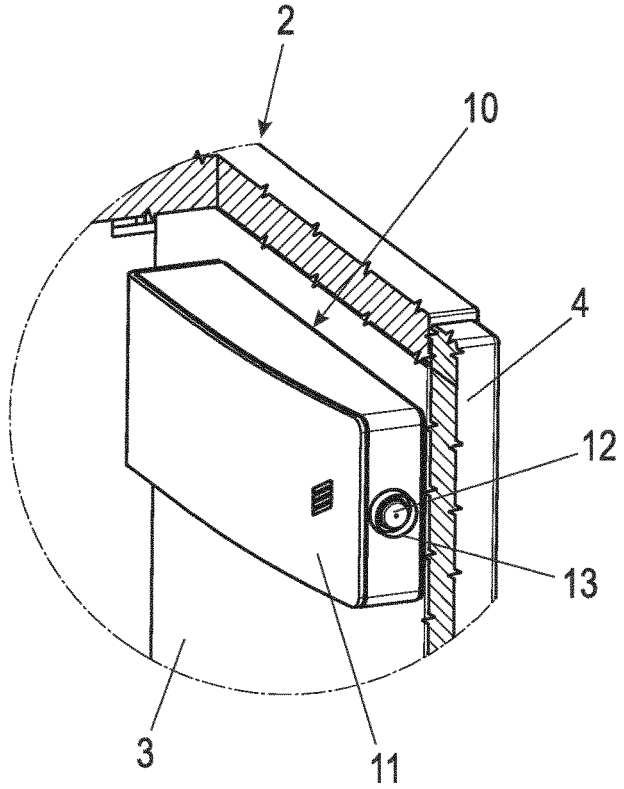

The invention will be explained in more detail below by means of embodiment examples shown in the drawings, wherein:

FIG. 1*a* shows an isometric representation of an item of furniture with an ejection apparatus;

FIG. 1*b* shows an enlargement of a section of FIG. 1*a;*

Figure 2:
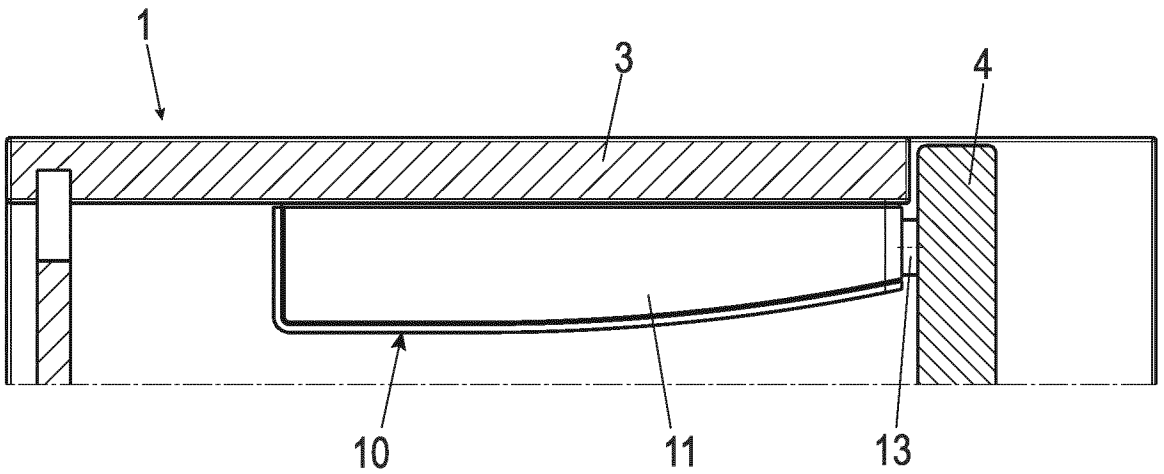
Figure 3:
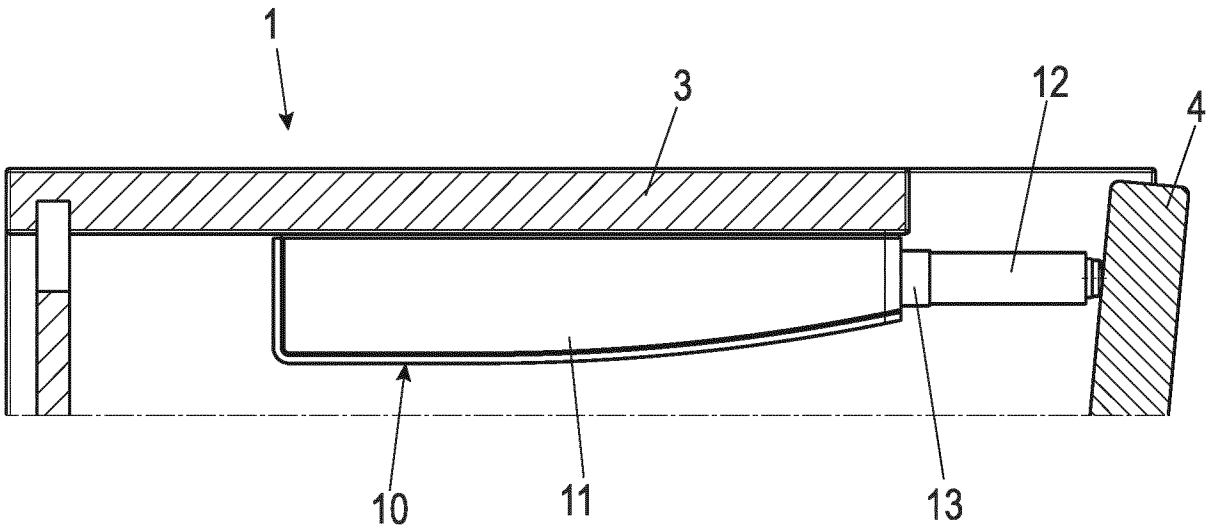
Figure 4A:
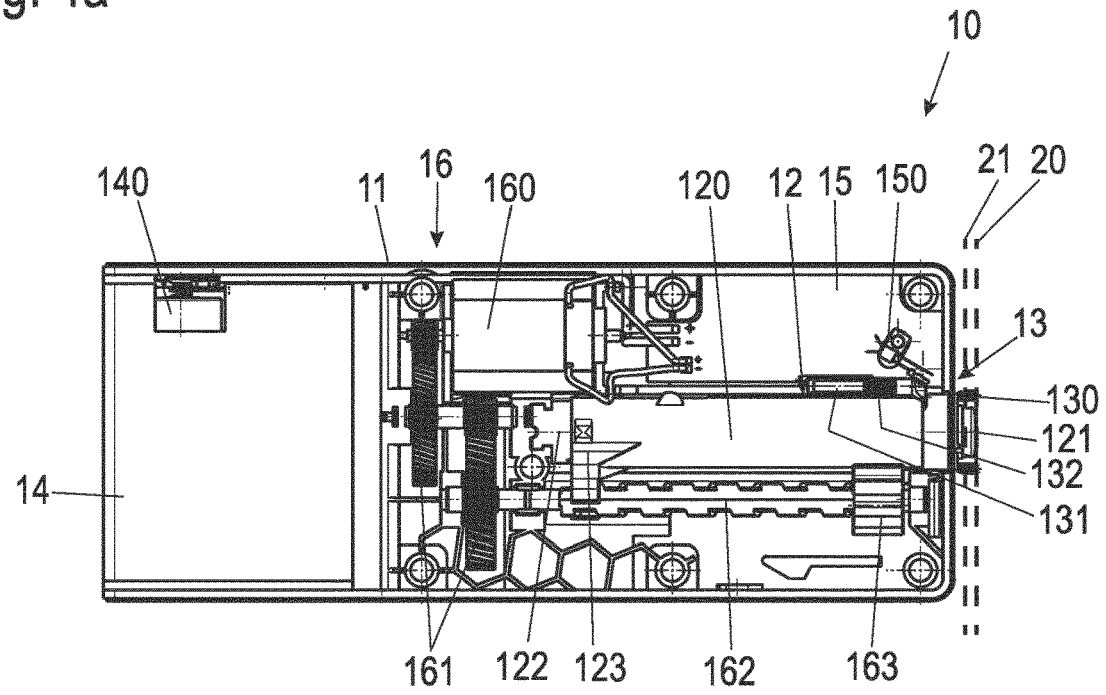
Figure 5A:
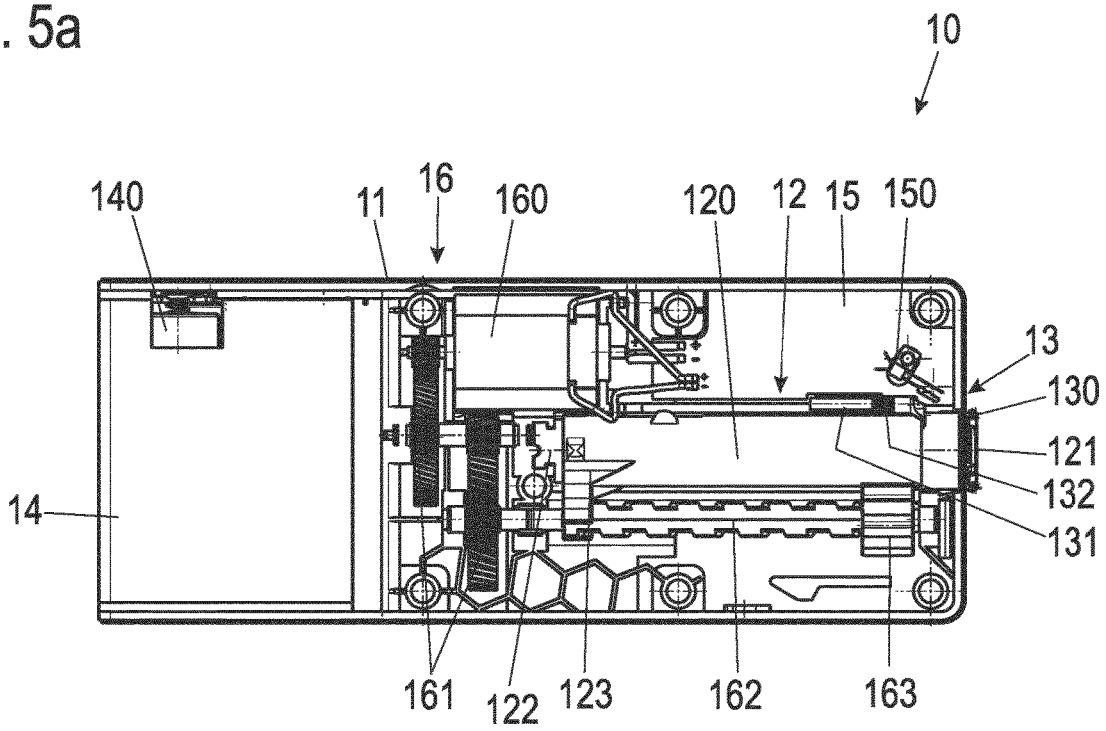
Figure 9A:
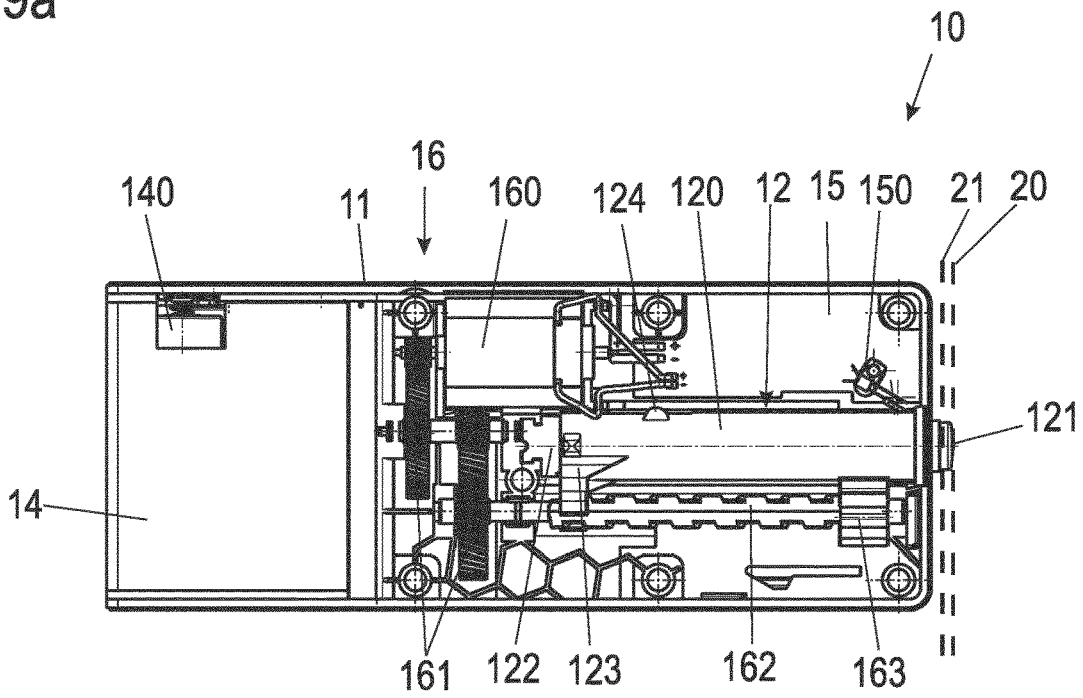
Figure 10A:
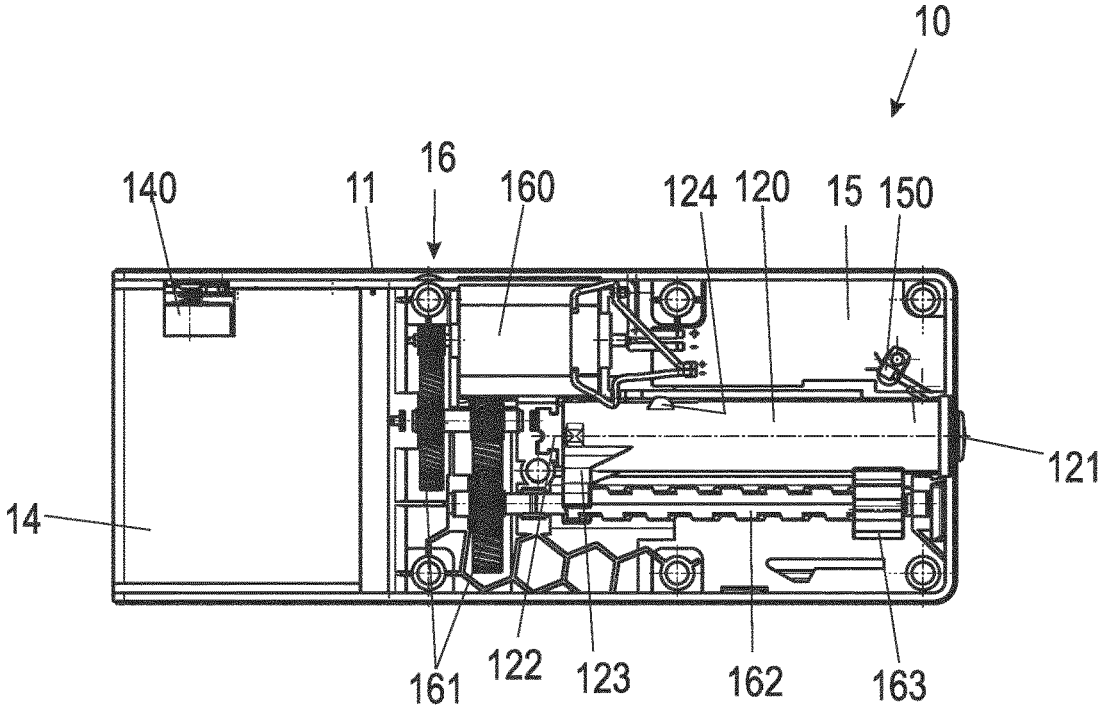

FIGS. 2, 3 each show a sectional view of a section of the item of furniture from FIG. 1*a* in different operating positions of the ejection apparatus;

FIGS. 4*a, b* show a plan view and an oblique view of an ejection apparatus in a first embodiment example in a rest position;

FIGS. 5*a, b* to 8*a, b* show the ejection apparatus of the first embodiment example in different operating positions;

FIGS. 9*a, b* show a plan view and an oblique view of an ejection apparatus in a second embodiment example in a rest position; and FIGS. 10*a, b* to 12*a, b* show the ejection apparatus of the second embodiment example in different operating positions.

DETAILED DESCRIPTION

FIG. 1 shows in an isometric view of an item of furniture 1 with an opening and closing apparatus according to the application. As an example, a cabinet is shown here as furniture 1. Furniture 1 has a body 2 with side walls 3. On the side wall 3, which is shown in the figure on the left, a door is hinged as a movable furniture part 4 (hereafter also referred to as door 4) with a movement fitting (not illustrated here). The movement fitting here, which has two hinges in this case for example, is equipped with a (self-)retraction apparatus, preferably with a damping apparatus, so that door 4 is retracted during the closing process as soon as a certain opening angle is undershot.

On the opposite side wall 3, an ejection apparatus 10 is mounted, as can be seen from the cut-outs in body 2 and door 4. The section of furniture 1 with the ejection apparatus 10 is shown in FIG. 1*b* enlarged in more detail.

The ejection apparatus 10 comprises a housing 11 from which a plunger 12 can extend to push open door 4. Concentrically to plunger 12, a sleeve 13 is arranged, which serves to control the ejection apparatus 10, as will be explained in more detail below.

FIGS. 2 and 3 each show a horizontal section through furniture 1 and the ejection apparatus 10 in the area of the ejection apparatus 10. The figures show two different operating states of the ejection apparatus 10. FIG. 2 shows furniture 1 with closed door 4, wherein the ejection apparatus 10 is in a rest position. In this state, both the plunger 12 (not visible in this FIG. 2) and the sleeve 13 rest against the inner surface of the door 4. A gap is visible between door 4 and side wall 3, which allows door 4 to be pushed in the direction of furniture body 2. This movement is used to trigger the ejection apparatus 10.

FIG. 3 shows the ejection apparatus 10 with plunger 12 extended. The extended plunger 12 has correspondingly opened door 4 against the closing force of the self-retraction apparatus of the movement fitting. The sleeve 13, which is also displaceably mounted in the ejection apparatus 10 in its movement independently of the plunger 12, is also disengaged from the position shown in FIG. 2. Compared to the plunger 12, which performs an opening movement in the range of a few 10 mm, the sleeve 13 is only disengaged by a few millimeters. As will be explained in detail below, the disengagement of the sleeve 13 is used to detect the position of door 4 independently of plunger 12.

When moved by the plunger 12, in the operating position shown in FIG. 3 the door 4 is opened so far that a user can comfortably reach behind door 4 and open it completely. The opening angle of the door 4 is selected in this case by the geometry of the door 4, the positioning of the ejection apparatus 10 and the stroke of the plunger 12 so that it is still within the angle range in which the self-retraction apparatus of the movement fitting is active. Accordingly, door 4 rests against plunger 12 with the force applied by the retraction apparatus, which prevents the door 4 from swinging open uncontrolled after the ejection process. This also ensures that after the plunger 12 has been retracted, door 4—if it has not been opened by the user—is returned by the retraction apparatus again to the closed position according to FIG. 2. This ensures automatic closing of door 4 in the event of unintentional actuation of ejection apparatus 10.

Figure 4B:
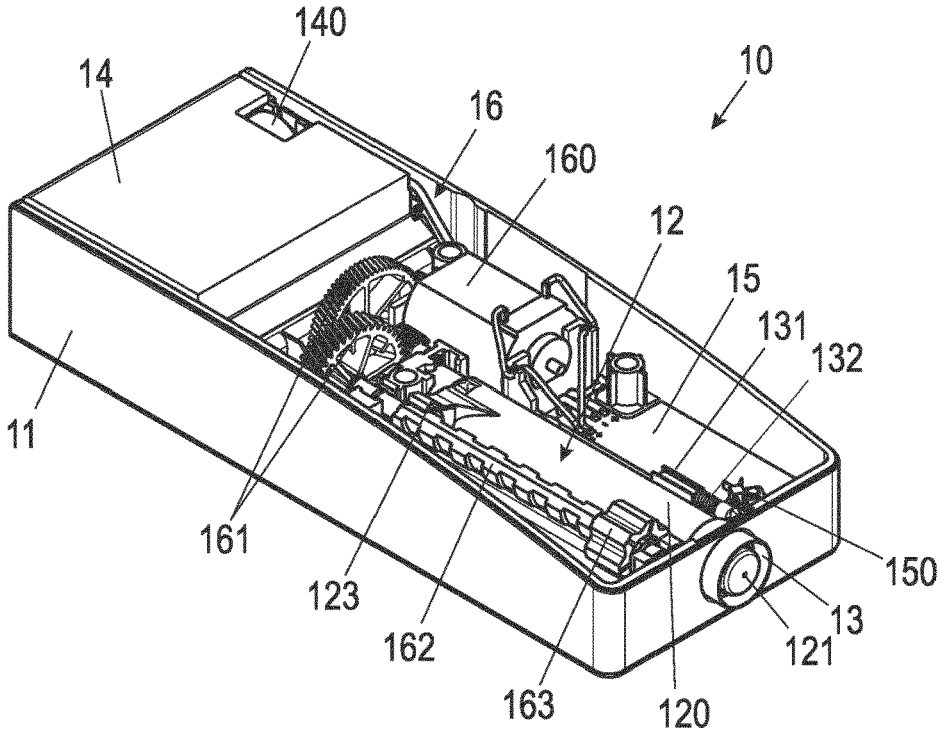

The ejection apparatus 10 is shown in more detail in a plan view in FIG. 4*a*. A housing cover is removed from the housing 11 to allow a view into the internal structure of the ejection apparatus 10. FIG. 4*b* shows the ejection apparatus 10 in the same operating position as FIG. 4*a* in an isometric diagonal view.

The ejection apparatus 10 has an essentially rectangular oversize. The side facing the user, from which the plunger 12 also exits, is hereinafter also referred to as the front area of the ejection apparatus 10. In the opposite rear area of the ejection apparatus 10 a battery compartment 14 is arranged in which batteries 140 can be inserted for the power supply of the ejection apparatus 10. Batteries 140 can be disposable or rechargeable batteries. An electricity consumption, in particular a quiescent current consumption of the ejection apparatus 10, is minimized in such a way that a battery life of up to two years can be achieved with an average actuation frequency of up to 20 ejection cycles per day.

In the front area of the ejection apparatus 10 a control device is arranged on one of the two sides (in FIG. 4*a* above the plunger 12) on a circuit board 15. The circuit board 15 carries electronic components (not shown in detail) for controlling the ejection apparatus 10, in particular a microcontroller, which is preferably constructed in CMOS (complementary metal-oxide semiconductor) technology to achieve a low quiescent current. Connected to the microcontroller is a motor driver, preferably constructed as an H-bridge with switching elements having a low contact resistance. These can preferably be MOSFET switching elements or IGBT switching elements. A current measuring device, such as a shunt, which is in series with the motor driver or is integrated into the motor driver, is further preferably provided in order to be able to measure a motor current.

A drive unit 16 for the plunger 12 is arranged in a central area of the ejection apparatus 10. The drive unit 16 comprises a motor 160, preferably a low-voltage DC motor, which is connected to and controlled by the control unit on circuit board 15. The motor 160 is followed by a gear unit 161, in this case a gear unit with two gear stages, each with helical gears. Due to the helical gearing, a reduction can be achieved by the gear 161 with low noise development. On the output side, the gear unit 161 is coupled to a spindle 162, which is arranged essentially parallel to the plunger 12 in the longitudinal direction of the housing 11. A spindle nut 163 is mounted on the spindle 162, which is guided in the housing 11 in a rotationally fixed manner and is displaceably guided in the longitudinal direction.

In the rest position shown in FIGS. 4*a* and 4*b*, the spindle nut 163 is at a front stop, i.e., at maximum distance from the gear 161. When moving the spindle nut 163 by rotating the spindle 162 in the corresponding direction, the end position of the spindle nut 163 is found by moving the spindle nut 163 against a stop formed by the housing 11. Due to the mechanical stop, the current of the motor 160 rises above a limit value, which is detected by the control device on the circuit board 15, whereupon the motor 160 is switched off in the end position of the spindle nut 163. The limit value is preferably dependent on a measured voltage of the batteries 140. Alternatively, a sensor could also be provided to detect the end position of the spindle nut 163, for example in the form of a limit switch.

The plunger 12 has a shaft 120 which, in the position of the plunger 12 shown, is essentially disposed inside the housing 11. With the shaft 120, the plunger 12 is guided longitudinally displaceably in the housing 11. At the front end of the shaft 120, the plunger 12 with a head 121 protrudes slightly above the front surface of the housing 11. The head 121 may be made of a rubberized or other elastic material in order to ensure that the plunger 12 hits the door 4 as noiselessly as possible. On the side opposite the head 121 the plunger 12 is coupled with a heart cam control 122. As is well known, the heart cam control 122 is designed to lock the plunger 12 in the retracted position shown. In this state it is pretensioned by a spring arranged inside plunger 12, which is not visible in this operating position of plunger 12. A driver 123, in which the spindle nut 163 can engage and move back an extended plunger 12, is arranged on the side of the plunger 12.

As already explained in connection with FIGS. 1*a* and 1*b*, the plunger 12 is concentrically surrounded by a sleeve 13. This has a ring 130 in the outer area, which is also longitudinally displaceably guided by a laterally arranged guide 131. A spring 132 is arranged in the area of the guide 131, which moves the ring 130 out of the housing 11 with low spring force. The length of the ring 130 ranges from a few millimeters to one centimeter. The range of motion of the sleeve 13 out of the housing 11 is also limited to a few millimeters. With a projection formed on the ring 130 or on the guide 131, the sleeve 13 actuates the microswitch 150, which is arranged on the circuit board 15. In this case, the sleeve 13 and the microswitch 150 are positioned so that an extension of the sleeve 13 out of the housing 11 from a certain position of the sleeve 13 is detected.

Different operating positions of the ejection apparatus 10 and different operating positions of the plunger 12 and the driver 123 are shown below using FIGS. 5*a* to 8*a* and 5*b* to 8*b* respectively. The figures with index a show the ejection apparatus 10 in each case in a plan view analogous to FIG. 4*a*, figures with index b in a symmetrical oblique view correspondingly analogous to FIG. 4*b*.

In FIG. 4*a* a first vertical dashed line 20 indicates the rest position of the front surface of the head 121 of the plunger 12 and also of the sleeve 13. In this position the head 121 or the sleeve 13 is located with the door 4 closed according to FIG. 1*a* or FIG. 2.

To open door 4, it is moved out of the rest position (line 20) in the direction of furniture body 2. The range of motion for door 4 in the direction of body 1 is given by the gap between door 4 and side wall 3 shown in FIG. 2. It is a few millimeters (mm), in particular about 2 mm. The position to which the door 4 and thus the head 121 of the plunger 12 can be moved is shown in FIG. 4*a* by a second dashed line 21.

Figure 5B:
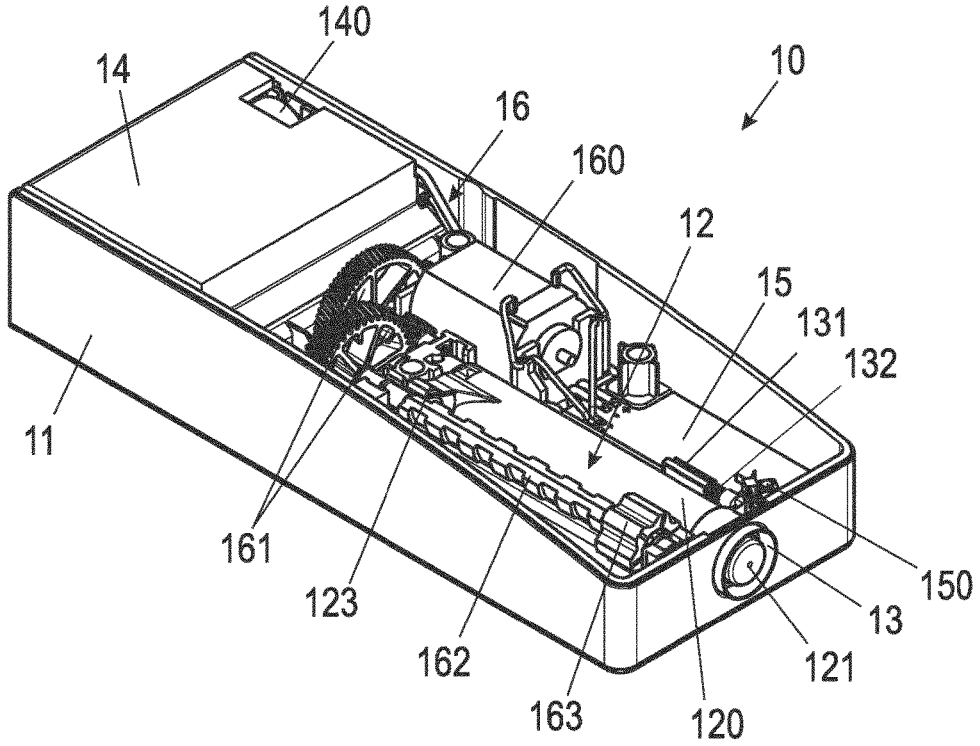

FIGS. 5*a* and 5*b* show the ejection apparatus 10 again in exactly this position (line 21). Pressing the plunger 12 into this position causes the locking mechanism of the heart cam control 122 to release, so that the plunger 12 is then extended by the applied spring force of the spring and the door 4 is pushed open as soon as the user releases the door 4 for this purpose after pressing it in.

Figure 6A:
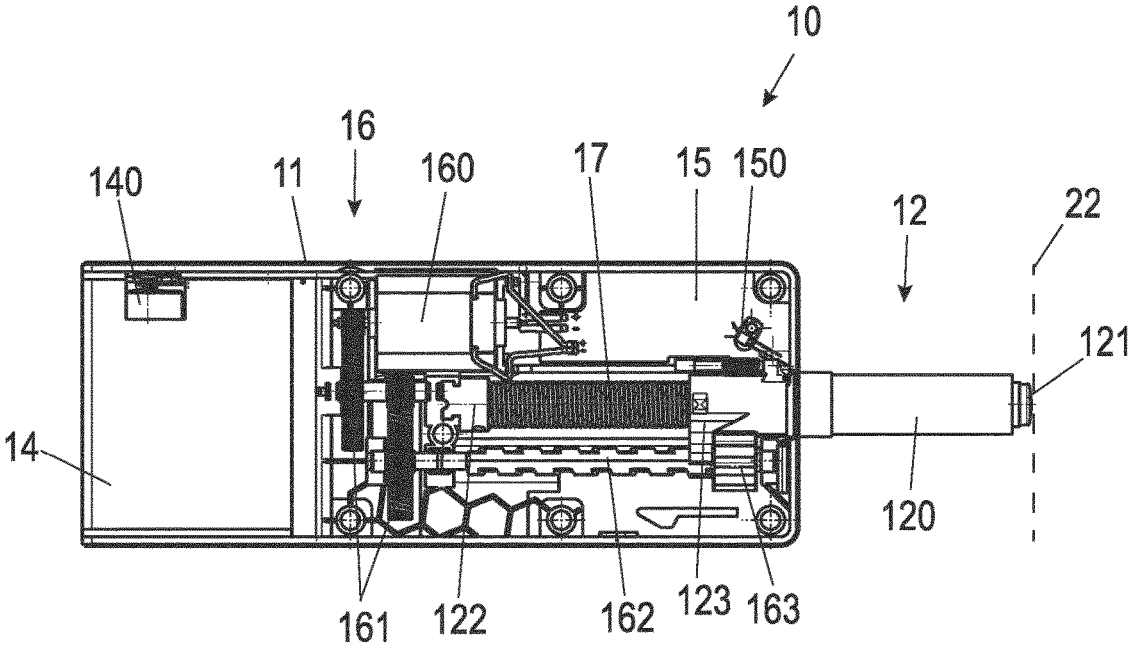
Figure 6B:
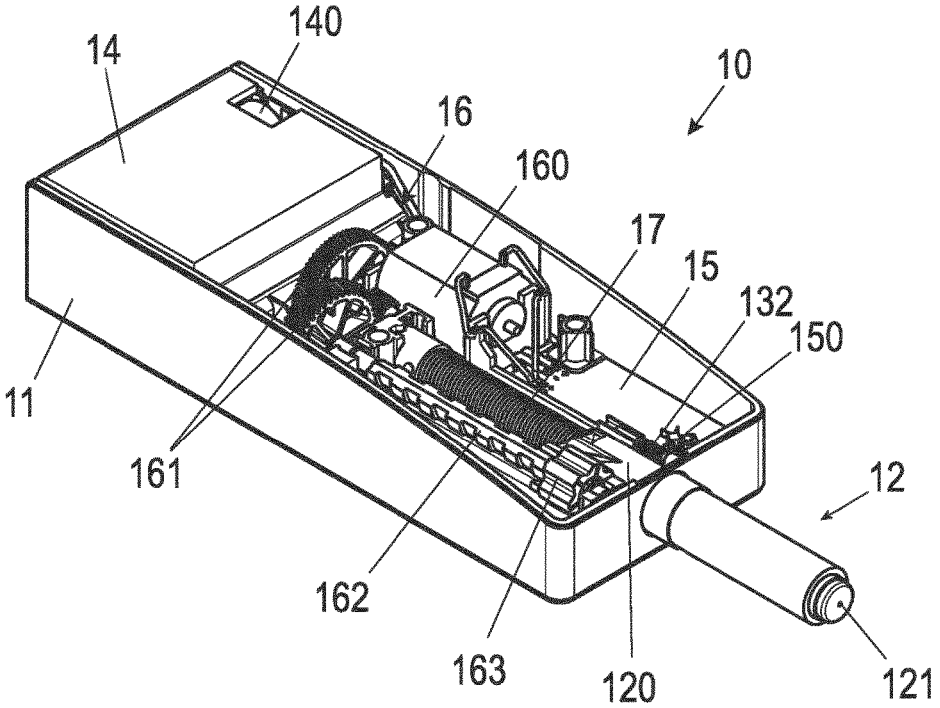

FIGS. 6*a* and 6*b* show the ejection apparatus 10 after the plunger 12 has fully extended. The position of the head 121 of the fully extended plunger 12 is indicated by a dashed line 22 in FIG. 6*a*.

In FIGS. 6*a* and 6*b* the already mentioned spring, marked with the reference numeral 17, is visible. By pushing door 4 open, the ring 130 of sleeve 13 can also move, driven by spring 132, to a maximum extended position, thus actuating switch 150. The opening of door 4 is thus detected by switch 150, which then activates the control device on the circuit board 15. A timer is first started in the control unit, which initially runs without further actions for an adjustable or preset time. During this time the user is given the opportunity to grasp behind and completely open the door 4 pushed open by the plunger 12. The time can range from a few seconds to a few tens of seconds.

Figure 7A:
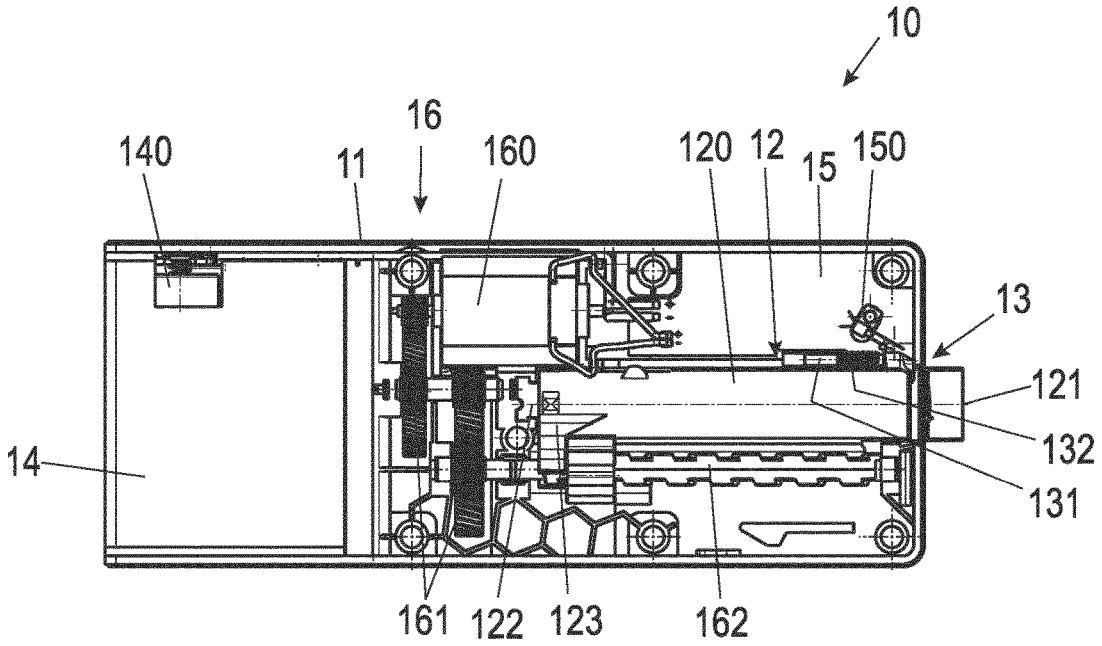
Figure 7B:
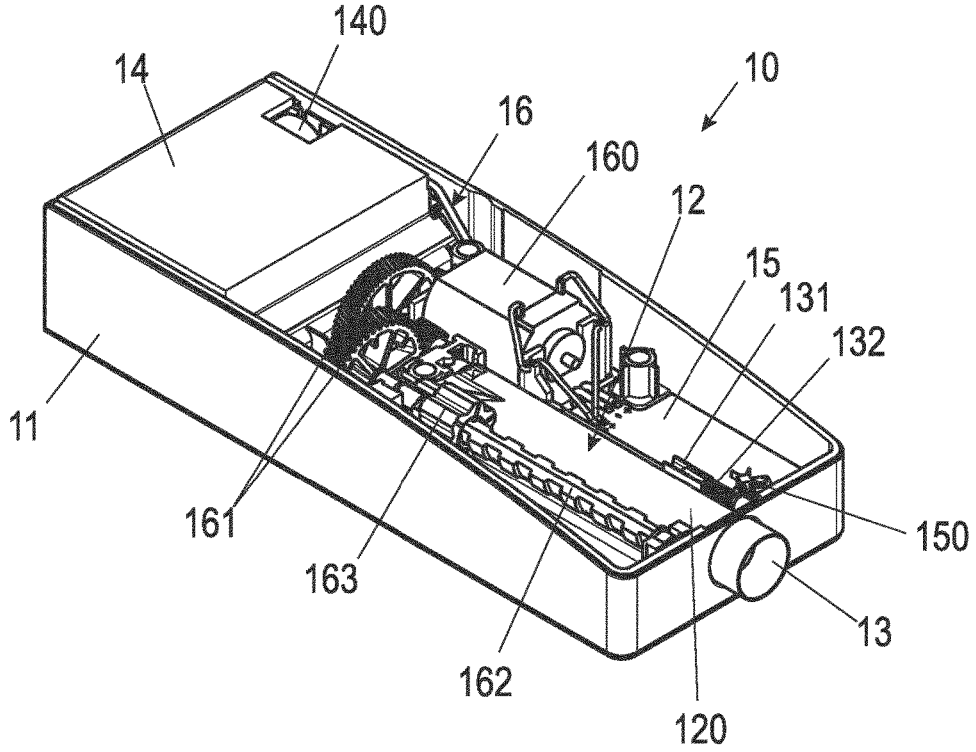

After this time has elapsed, the motor 160 is activated and the spindle 162 rotates so that the spindle nut 163 moves in the direction of the battery compartment 14. The spindle nut 163 engages in this case in the driver 123 of the plunger 12 and correspondingly pulls the plunger 12 back into the housing 11, wherein the spring 17 is tensioned. As shown in FIGS. 7*a* and 7*b*, sleeve 13 remains in the extended position because door 4 is not yet closed. The spindle 12 is retracted up to a state in which the spring 17 is fully tensioned and the heart cam control 122 locks the plunger 12. This end position of the plunger 12 can also be measured by measuring the operating current of the motor 160.

Figure 8A:
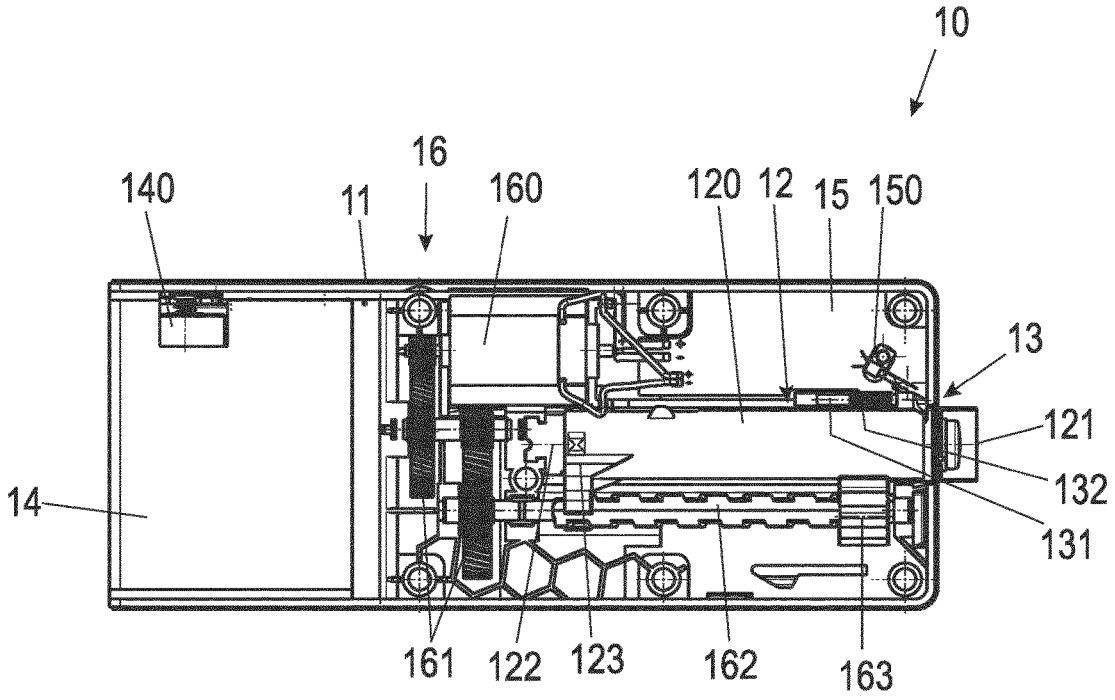
Figure 8B:
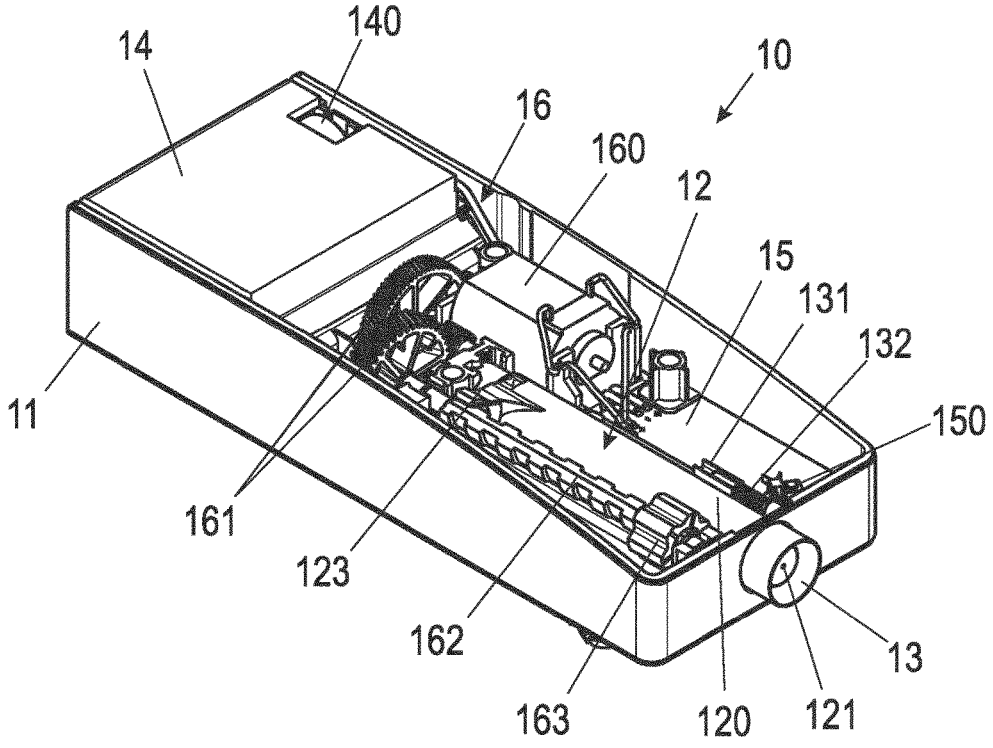

After moving the plunger 12 into the mentioned locked end position, the motor 160 is reversed to turn the spindle 162 in the opposite direction. The spindle nut 163 moves back accordingly to the front stop as shown in FIGS. 8*a* and 8*b*. After manual closing of door 4 by the user, the system returns to the initial state shown in FIGS. 4*a* and 4*b*.

If, starting from the operating position shown in FIGS. 6*a* and 6*b*, door 4 is not manually opened further by the user, it will close again when plunger 12 is retracted due to the retraction apparatus. Even then, when the spindle nut 163 is extended again, the system returns to the operating state shown in FIGS. 4*a* and 4*b*.

FIGS. 9*a* to 12*a* and 9*b* to 12*b* respectively show a second embodiment example of an ejection apparatus 10 in plan view or an isometric oblique view in the same way as FIGS. 4*a* to 8*a* and 4*b* to 8*b*, respectively. In these figures, the same reference numerals mark the same or equivalent elements as in the preceding figures.

With regard to the basic construction, the ejection apparatus 10 shown in FIGS. 9*a* to 12*a* and 9*b* to 12*b* corresponds to the ejection apparatus 10 of the first embodiment example, the description of which is hereby referred to. In particular, the ejection apparatus 10 of the second embodiment example as well as that of the first embodiment example can be used for the furniture shown in FIG. 1*a*.

In contrast to the first embodiment example, the ejection apparatus 10 shown here does not have a sleeve 13, via which the position of the moved furniture part was detected in interaction with the switch 150 in the first embodiment example. Instead of the sleeve 13, a protruding actuator 124 is attached to the shaft 120 of the plunger 12 in the rear area of the plunger 12, which actuates the switch 150 when the plunger 12 is fully extended. In this way, an open furniture door is detected using the extended plunger 12.

Figure 9B:
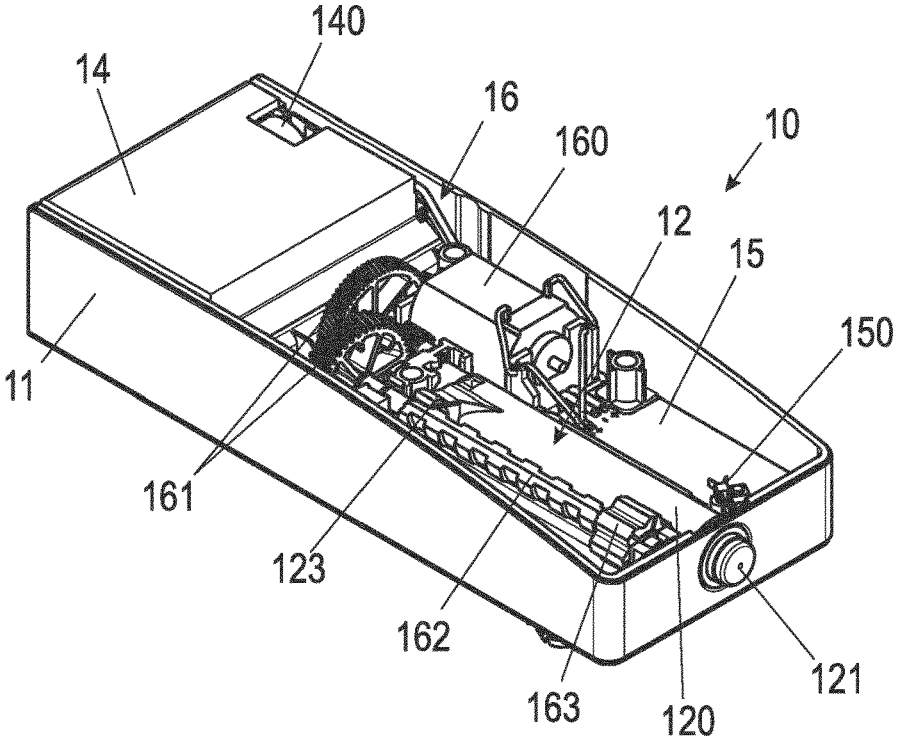
Figure 10B:
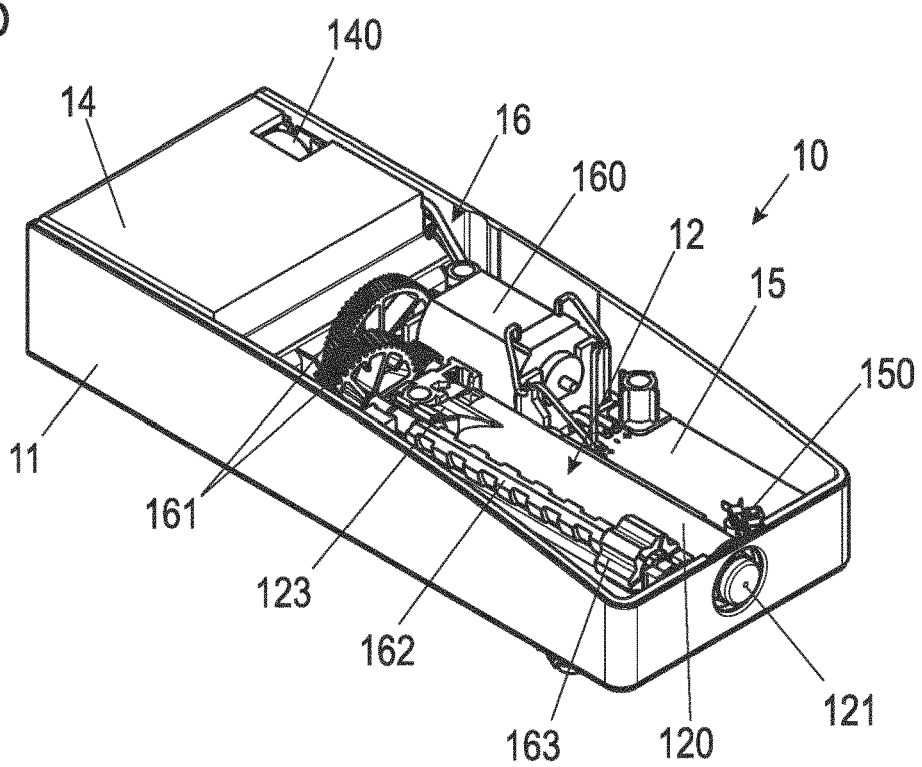

In FIGS. 9*a* and 9*b*, the ejection apparatus 10 is first shown in the rest position, in which the spring 17, which is again not visible here, is fully tensioned and the plunger 12 is latched by the heart cam control 122. Pressing in the movable furniture part, for example door 4 according to FIG. 1*a*, pushes in the plunger 12 and thus unlocks the heart cam control 122. This is shown in FIGS. 10*a* and 10*b*.

Figure 11A:
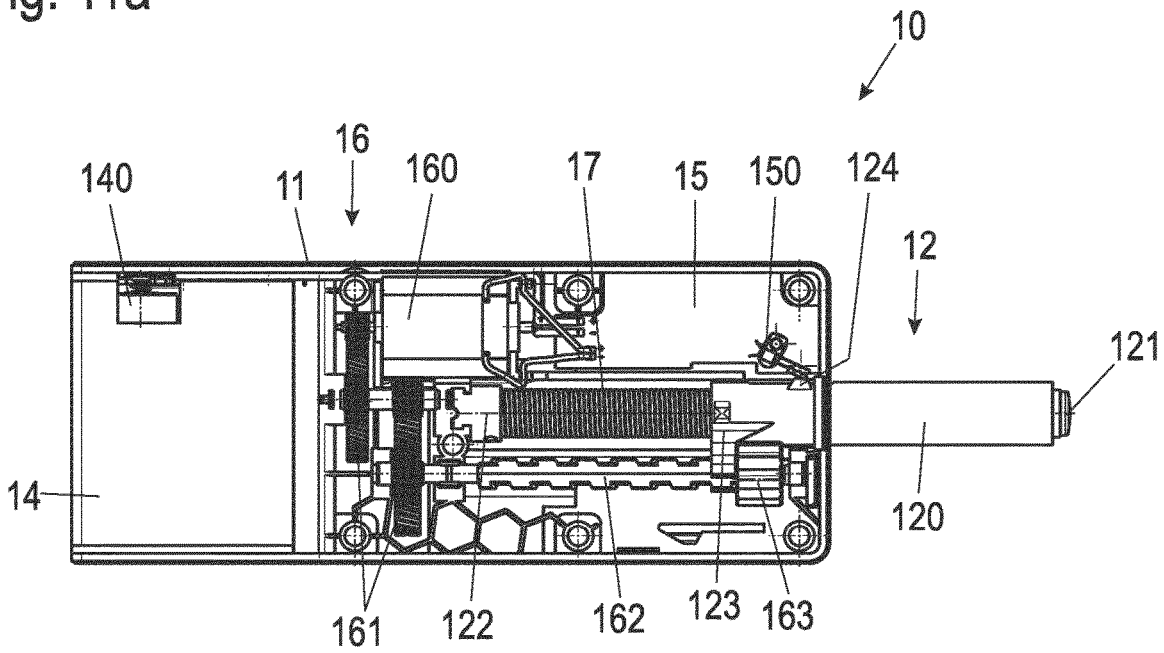
Figure 11B:
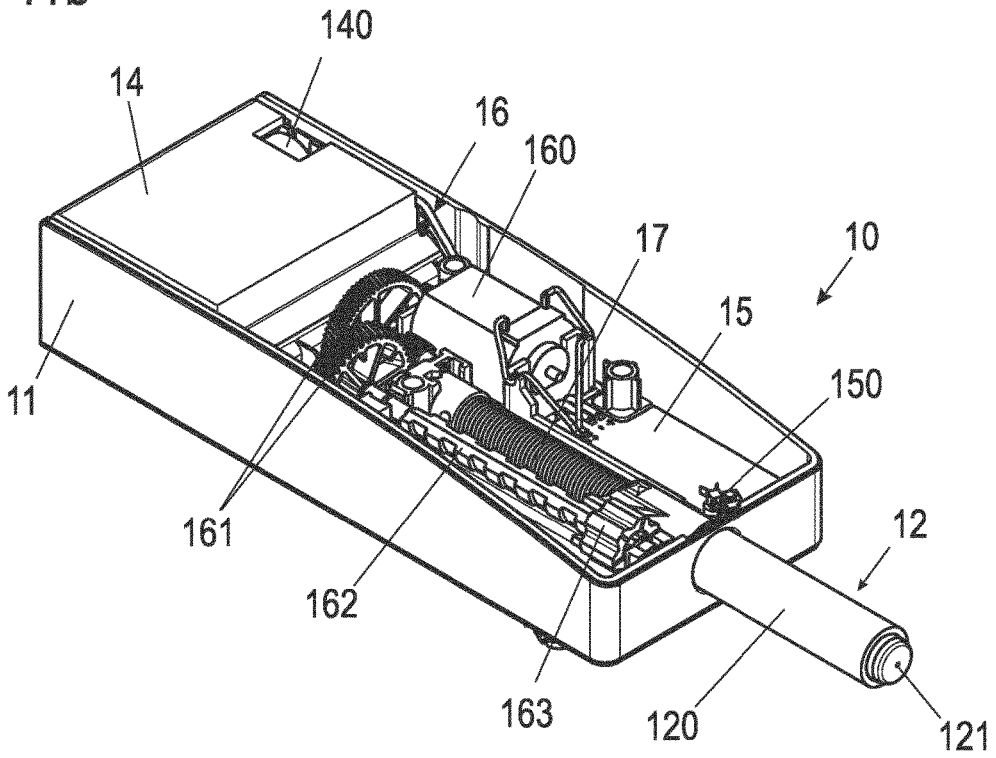

As a result, the plunger 12 extends driven by the spring 17 and opens the movable furniture part. The fully extended position is shown in FIGS. 11*a* and 11*b*. In FIG. 11*a* the actuation of switch 150 by actuator 124 is clearly visible.

Figure 12A:
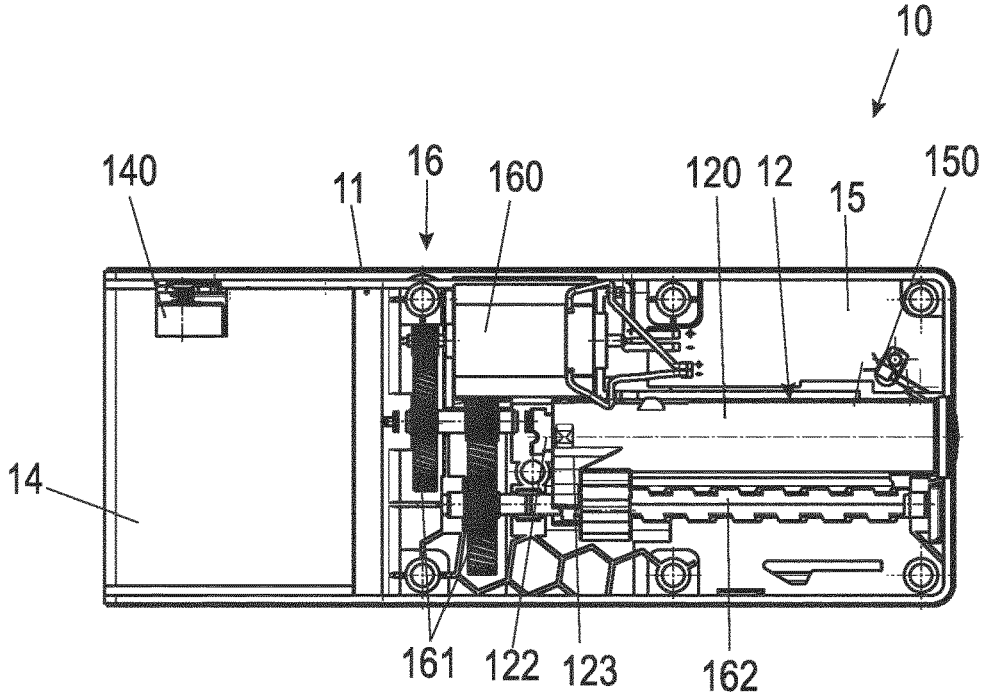
Figure 12B:
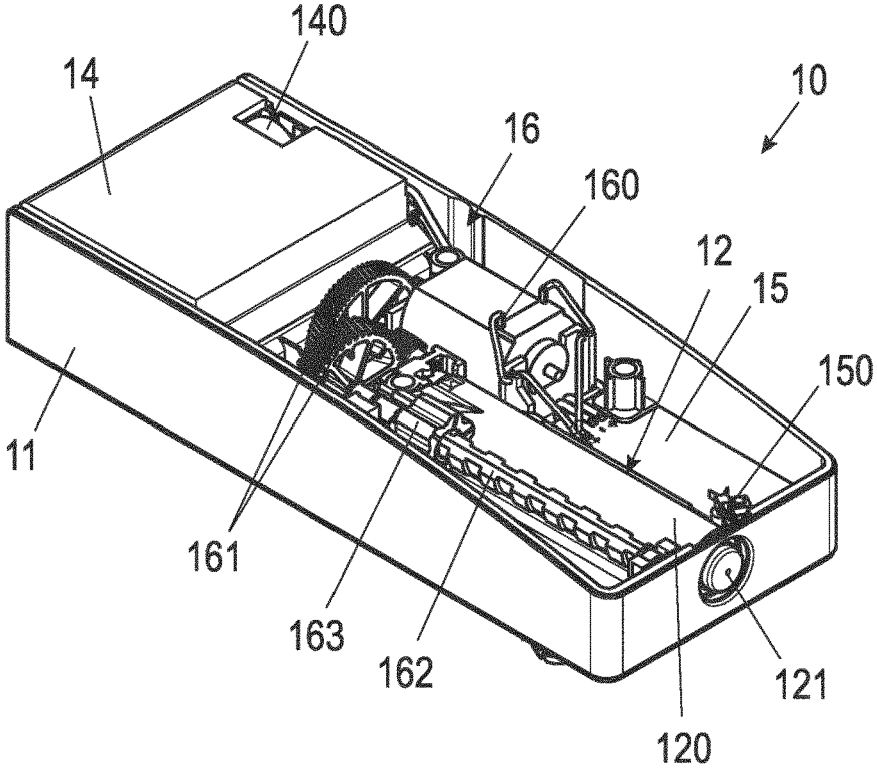

After the predetermined or adjustable waiting time has elapsed, the drive motor 160 is again operated in a direction of rotation, in which the spindle nut 163 pulls the plunger 12 into the housing 11 via the driver 123 and clamps the spring 17 in this process. The position of the spindle nut 163 at the end of this retracting and tensioning operation is shown in FIGS. 12*a* and 12*b*. By retracting, the heart cam control 122 locks the plunger 12 again in the fully retracted position of the plunger 12. After the spindle nut 163 is returned to the front position, the system returns to the rest position shown in FIGS. 9*a* and 9*b*.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Furniture
2 Body
3 Side wall
4 Movable furniture part (door)
10 Ejection apparatus
11 Housing
12 Plunger
120 Shaft
121 Head
122 Heart cam control
123 Driver
124 Actuator
13 sleeve
130 Ring
131 Guide
132 Spring
14 Battery compartment
140 Battery
15 Circuit board
150 Switch
16 Drive unit
160 Motor
161 Gear
162 Spindle
163 Spindle nut
17 Spring
20, 21, 22 Line (for position marking)

The invention claimed is:

1. An opening and closing system for an item of furniture having at least one movable furniture part and a movement fitting, the opening and closing system comprising:
- an ejection apparatus comprising
  - a loadable mechanical force store;
  - a tensioning apparatus configured to load the mechanical force store;
  - an electrical energy storage device configured to supply energy to the tensioning apparatus,
  - wherein the ejection apparatus is configured, when the mechanical energy store is unlocked, to move the movable furniture part into a partially open position,
  - wherein the movement fitting comprises a retraction apparatus and a damping apparatus configured to move the movable furniture part in a damped manner from a further partially open position lying within a predetermined effective range into a closed position, and the partially open position of the movable furniture part achieved by the ejection apparatus lies within the predetermined effective range of the retraction apparatus.

2. The opening and closing system of claim 1, wherein the ejection apparatus further comprises a linearly displaceable plunger as an ejection element for the movable furniture part.

3. The opening and closing system of claim 2, wherein the loadable mechanical force store is a spring.

4. The opening and closing system of claim 3, further comprising:
- a heart cam control configured to lock the plunger in a retracted rest position when the spring is tensioned and to release the plunger beyond the retracted rest position after mechanical impression.

5. The opening and closing system of claim 4, wherein the tensioning apparatus comprises:
- an electric motor with a downstream gear and a spindle, wherein a spindle nut arranged on the spindle engages in a driver of the plunger in order to move the plunger into the retracted rest position.

6. The opening and closing system of claim 5, wherein the ejection apparatus further comprises:
- a circuit board with a control device having a microcontroller and switching elements controlled by the microcontroller in an H-bridge arrangement.

7. The opening and closing system of claim 6, wherein the switching elements of the H-bridge arrangement are MOSFETs or IGBTs.

8. The opening and closing system of claim 6, wherein the control device comprises:
- a current measurer configured to measure an operating current of the motor.

9. The opening and closing system of claim 8, wherein the control device is configured to detect an end position of the spindle nut by exceeding a predetermined limit value of the measured motor current.

10. The opening and closing system of claim 9, wherein the limit value is dependent on a measured voltage of the electrical energy storage device.

11. The opening and closing system of claim 2, in which the tensioning apparatus comprises a sensor configured to detect a position of the plunger.

12. The opening and closing system of claim 2, wherein the ejection apparatus further comprises:

a mechanical slide projecting in a pretensioned manner beyond a housing of the ejection apparatus, wherein, in a closed position of the movable furniture part, the mechanical slide rests against the housing of the ejection apparatus; and a sensor configured to detect a position of the slide.

13. The opening and closing system of claim 12, wherein the mechanical slide is a sleeve arranged concentrically relative to the plunger around the plunger.

14. The opening and closing system of claim 12, wherein the sensor is a pushbutton having contacts that are open when the movable furniture part is in the closed position.

15. The opening and closing system of claim 1, wherein the electrical energy storage device comprises at least one battery arranged in the ejection apparatus.

16. The opening and closing system of claim 1, wherein the movement fitting is formed by a hinge with a hinge pot on the at least one moveable furniture part and a hinge arm, and wherein the hinge has a closing spring and a damping apparatus.

17. The opening and closing system of claim 16, wherein the damping apparatus has a tension or compression linear damper or a rotary damper in the hinge and the damper is arranged in the hinge pot or in the hinge arm.

18. The opening and closing system of claim 17, wherein the tension or compression linear damper is pivotably arranged in the hinge arm and is coupled via a coupling at least temporarily to at least one articulated arm of the hinge.

19. The opening and closing system of claim 17, wherein the rotational damper is arranged in the hinge pot and is coupled via coupling means at least temporarily to at least one articulated arm of the hinge.

20. A method for operating an opening and closing system for an item of furniture comprising at least one movable furniture part and a hinge with a retraction apparatus and a damping apparatus, wherein the opening and closing system comprises an ejection apparatus with a loadable mechanical force store and a tensioning apparatus for loading the mechanical force store, wherein the tensioning apparatus is supplied with energy by an electrical energy storage device, the method comprising:

moving, by the ejection apparatus, the movable furniture part into a partially open position by manually pressing the movable furniture part by an ejection element;

loading by the tensioning apparatus, after a predetermined period of time, the mechanical force store and retracting the ejection element; and moving, during the retraction of the ejection element, the movable furniture part into a closed position by the retraction apparatus of the hinge and against a damping action of the damping apparatus.

21. The method of claim 20, wherein the ejection element is a linearly movable plunger and the tensioning apparatus of the ejection apparatus has an electric motor with a downstream gear and a spindle, wherein a spindle nut arranged on the spindle engages in a driver of the plunger, wherein during the tensioning operation the spindle nut is moved in such a way that the plunger is moved into a retracted position, and the spindle nut is subsequently moved in an opposite direction to a rest position.

22. The method of claim 21, wherein a heart cam controller locks the plunger in a retracted rest position, and wherein the retracted rest position of the plunger for locking is reached while the spindle nut moves into the direction of its rest position.

* * * * *